US007194789B2

(12) United States Patent
Thomaschefsky et al.

(10) Patent No.: US 7,194,789 B2
(45) Date of Patent: Mar. 27, 2007

(54) ABRADED NONWOVEN COMPOSITE FABRICS

(75) Inventors: Craig Farrell Thomaschefsky, Marietta, GA (US); Larry M. Brown, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 124 days.

(21) Appl. No.: 10/744,608

(22) Filed: Dec. 23, 2003

(65) Prior Publication Data

US 2005/0136777 A1 Jun. 23, 2005

(51) Int. Cl.
*D06C 11/00* (2006.01)
*D04H 5/02* (2006.01)

(52) U.S. Cl. ..... 28/104; 26/28

(58) Field of Classification Search ..... 28/103, 28/104, 105, 106, 107, 110, 111, 112, 165; 26/28, 29 R, 32, 37; 442/383, 384, 408, 442/402, 403; 428/90, 91; 162/112, 113, 162/204

See application file for complete search history.

(56) References Cited

U.S. PATENT DOCUMENTS

| | | | | |
|---|---|---|---|---|
| 2,666,369 A | | 1/1954 | Niks | |
| 3,337,388 A | | 8/1967 | Wosaba, II | |
| 3,338,992 A | | 8/1967 | Kinney | |
| 3,341,394 A | | 9/1967 | Kinney | |
| 3,485,706 A | | 12/1969 | Evans | |
| 3,491,821 A | | 1/1970 | Graumann et al. | |
| 3,502,538 A | | 3/1970 | Petersen | |
| 3,502,763 A | | 3/1970 | Hartmann | |
| 3,542,615 A | | 11/1970 | Dobo et al. | |
| 3,549,398 A | * | 12/1970 | Watson | 427/245 |
| 3,592,732 A | * | 7/1971 | Wand | 162/197 |
| 3,615,990 A | * | 10/1971 | Butler et al. | 156/148 |
| 3,692,618 A | | 9/1972 | Dorschner et al. | |
| 3,802,817 A | | 4/1974 | Matsuki et al. | |
| 3,821,068 A | | 6/1974 | Shaw | |
| 3,849,241 A | | 11/1974 | Butin et al. | |
| 3,855,046 A | | 12/1974 | Hansen et al. | |
| 3,908,057 A | * | 9/1975 | Smith, II | 428/151 |
| 3,936,555 A | * | 2/1976 | Smith, II | 428/151 |
| 3,956,560 A | * | 5/1976 | Smith, II | 428/218 |
| 4,100,324 A | | 7/1978 | Anderson et al. | |
| 4,107,374 A | | 8/1978 | Kusunose et al. | |

(Continued)

FOREIGN PATENT DOCUMENTS

GB 2378454 A 2/2003

(Continued)

OTHER PUBLICATIONS

Search Report and Written Opinion for PCT/US2004/019857, Nov. 17, 2004.

(Continued)

*Primary Examiner*—A. Vanatta
(74) *Attorney, Agent, or Firm*—Dority & Manning, P.A.

(57) ABSTRACT

A nonwoven composite fabric is provided that contains one or more abraded (e.g., sanded) surfaces. In addition to improving the softness and handfeel of the nonwoven composite fabric, it has been unexpectedly discovered that abrading such a fabric may also impart excellent liquid handling properties (e.g., absorbent capacity, absorbent rate, wicking rate, etc.), as well as improved bulk and capillary tension.

33 Claims, 6 Drawing Sheets

U.S. PATENT DOCUMENTS 4,144,370 A 3/1979 Boulton
4,145,468 A * 3/1979 Mizoguchi et al. ..... 442/269
4,165,556 A 8/1979 Nishida et al.
4,239,720 A 12/1980 Gerlach et al.
4,316,928 A 2/1982 Otto
4,340,563 A 7/1982 Appel et al.
4,468,844 A 9/1984 Otto
4,512,065 A 4/1985 Otto
4,608,128 A 8/1986 Farmer et al.
4,735,849 A 4/1988 Murakami et al.
4,795,668 A 1/1989 Krueger et al.
4,879,170 A 11/1989 Radwanski et al.
4,931,355 A 6/1990 Radwanski et al.
5,057,368 A 10/1991 Largman et al.
5,069,970 A 12/1991 Largman et al.
5,108,820 A 4/1992 Kaneko et al.
5,109,630 A * 5/1992 Love et al. ..... 451/183
5,112,421 A * 5/1992 Honda et al. ..... 156/148
5,137,600 A 8/1992 Barnes et al.
5,142,750 A * 9/1992 Dyer et al. ..... 26/29 R
5,162,074 A 11/1992 Hills
5,180,471 A 1/1993 Sauer et al.
5,277,976 A 1/1994 Hogle et al.
5,284,703 A 2/1994 Everhart et al.
5,336,552 A 8/1994 Strack et al.
5,350,624 A 9/1994 Georger et al.
5,382,400 A 1/1995 Pike et al.
5,389,202 A 2/1995 Everhart et al.
5,413,811 A 5/1995 Fitting et al.
5,466,410 A 11/1995 Hills
5,531,636 A 7/1996 Bissen
5,564,971 A 10/1996 Evensen
5,573,841 A 11/1996 Adam et al.
5,591,516 A 1/1997 Jaco et al.
5,620,779 A 4/1997 Levy et al.
5,662,515 A 9/1997 Evensen
5,704,101 A 1/1998 Majors et al.
D390,708 S 2/1998 Brown
5,752,300 A 5/1998 Dischler
5,785,179 A 7/1998 Buczwinski et al.
5,815,896 A 10/1998 Dischler
5,853,859 A 12/1998 Levy et al.
5,870,807 A * 2/1999 Beaty et al. ..... 28/167
5,888,916 A * 3/1999 Tadokoro et al. ..... 442/334
5,962,112 A 10/1999 Haynes et al.
5,964,351 A 10/1999 Zander
6,030,331 A 2/2000 Zander
6,063,717 A 5/2000 Ishiyama et al.
6,080,466 A 6/2000 Yoshimura et al.
D428,267 S 7/2000 Ramano, III et al.
6,093,665 A 7/2000 Sayovitz et al.
6,103,061 A 8/2000 Anderson et al.
6,112,381 A 9/2000 Dischler et al.
6,158,614 A 12/2000 Haines et al.
6,197,404 B1 3/2001 Varona
6,200,669 B1 3/2001 Marmon et al.
6,260,247 B1 7/2001 Dischler et al.
6,269,525 B2 8/2001 Dischler et al.
6,269,969 B1 8/2001 Huang et al.
6,269,970 B1 8/2001 Huang et al.
6,273,359 B1 8/2001 Newman et al.
6,315,864 B2 11/2001 Anderson et al.
6,423,393 B1 7/2002 Wildeman
6,592,960 B1 7/2003 Suzuki et al.
6,921,569 B2 * 7/2005 Dillinger ..... 428/91
2003/0118776 A1 6/2003 Anderson et al.
2003/0194932 A1 10/2003 Clark et al.
2004/0121121 A1 6/2004 Anderson et al.
2004/0121689 A1 6/2004 Anderson et al.

FOREIGN PATENT DOCUMENTS

WO WO 03097933 A1 11/2003

OTHER PUBLICATIONS

Product Information Sheets for Curtin-Hebert Co., Inc.'s 450 Series Microgrinder and 710 Series Sueding, Brushing, and Sanding, 4 pages.

* cited by examiner

ABRADED NONWOVEN COMPOSITE FABRICS

BACKGROUND OF THE INVENTION

Domestic and industrial wipers are often used to quickly absorb both polar liquids (e.g., water and alcohols) and nonpolar liquids (e.g., oil). The wipers must have a sufficient absorption capacity to hold the liquid within the wiper structure until it is desired to remove the liquid by pressure, e.g., wringing. In addition, the wipers must also possess good physical strength and abrasion resistance to withstand the tearing, stretching and abrading forces often applied during use. Moreover, the wipers should also be soft to the touch.

In the past, nonwoven fabrics, such as meltblown nonwoven webs, have been widely used as wipers. Meltblown nonwoven webs possess an interfiber capillary structure that is suitable for absorbing and retaining liquid. However, meltblown nonwoven webs sometimes lack the requisite physical properties for use as a heavy-duty wiper, e.g., tear strength and abrasion resistance. Consequently, meltblown nonwoven webs are typically laminated to a support layer, e.g., a nonwoven web, which may not be desirable for use on abrasive or rough surfaces. Spunbond webs contain thicker and stronger fibers than meltblown nonwoven webs and may provide good physical properties, such as tear strength and abrasion resistance. However, spunbond webs sometimes lack fine interfiber capillary structures that enhance the adsorption characteristics of the wiper. Furthermore, spunbond webs often contain bond points that may inhibit the flow or transfer of liquid within the nonwoven webs.

In response to these and other problems, nonwoven composite fabrics were developed in which pulp fibers were hydroentangled with a nonwoven layer of substantially continuous filaments. Many of these fabrics possessed good levels of strength, but often exhibited inadequate softness and handfeel. For example, hydroentanglement relies on high water volumes and pressures to entangle the fibers. Residual water may be removed through a series of drying cans. However, the high water pressures and the relatively high temperature of the drying cans essentially compresses or compacts the fibers into a stiff structure. Thus, techniques were developed in an attempt to soften nonwoven composite fabrics without reducing strength to a significant extent. One such technique is described in U.S. Pat. No. 6,103,061 to Anderson, et al., which is incorporated herein in its entirety by reference thereto for all purposes. Anderson, et al. is directed to a nonwoven composite fabric that is subjected to mechanical softening, such as creping. Other attempts to soften composite materials included the addition of chemical agents, calendaring, and embossing. Despite these improvements, however, nonwoven composite fabrics still lack the level of softness and handfeel required to give them a "clothlike" feel.

As such, a need remains for a fabric that is strong, soft, and also exhibits good absorption properties for use in a wide variety of wiper applications.

SUMMARY OF THE INVENTION

In accordance with one embodiment of the present invention, a method for forming a fabric is disclosed that comprises providing a nonwoven web that contains thermoplastic fibers. The nonwoven web is entangled with staple fibers to form a composite material. The composite material defines a first surface and a second surface. The first surface of the composite material is abraded.

In accordance with another embodiment of the present invention, a method for forming a fabric is disclosed that comprises providing a nonwoven web that contains thermoplastic continuous fibers. The nonwoven web is hydraulically entangled with pulp fibers to form a composite material. The pulp fibers comprise greater than about 50 wt. % of the composite material. The composite material defines a first surface and a second surface. The first surface of the composite material is abraded.

In accordance with still another embodiment of the present invention, a method for forming a fabric is disclosed that comprises providing a spunbond web that contains thermoplastic polyolefin fibers. The spunbond web is hydraulically entangled with pulp fibers to form a composite material. The pulp fibers comprise from about 60 wt. % to about 90 wt. % of the composite material. The composite material defines a first surface and a second surface. The first surface of the composite material is sanded.

In accordance with yet another embodiment of the present invention, a composite fabric is disclosed that comprises a spunbond web that contains thermoplastic polyolefin fibers. The spunbond web is hydraulically entangled with pulp fibers. The pulp fibers comprise greater than about 50 wt. % of the composite fabric, wherein at least one surface of the composite fabric is abraded. In some embodiments, the abraded surface may contain fibers aligned in a more uniform direction than fibers of an unabraded surface of an otherwise identical composite fabric. In addition, the abraded surface may contain a greater number of exposed fibers than an unabraded surface of an otherwise identical composite fabric.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
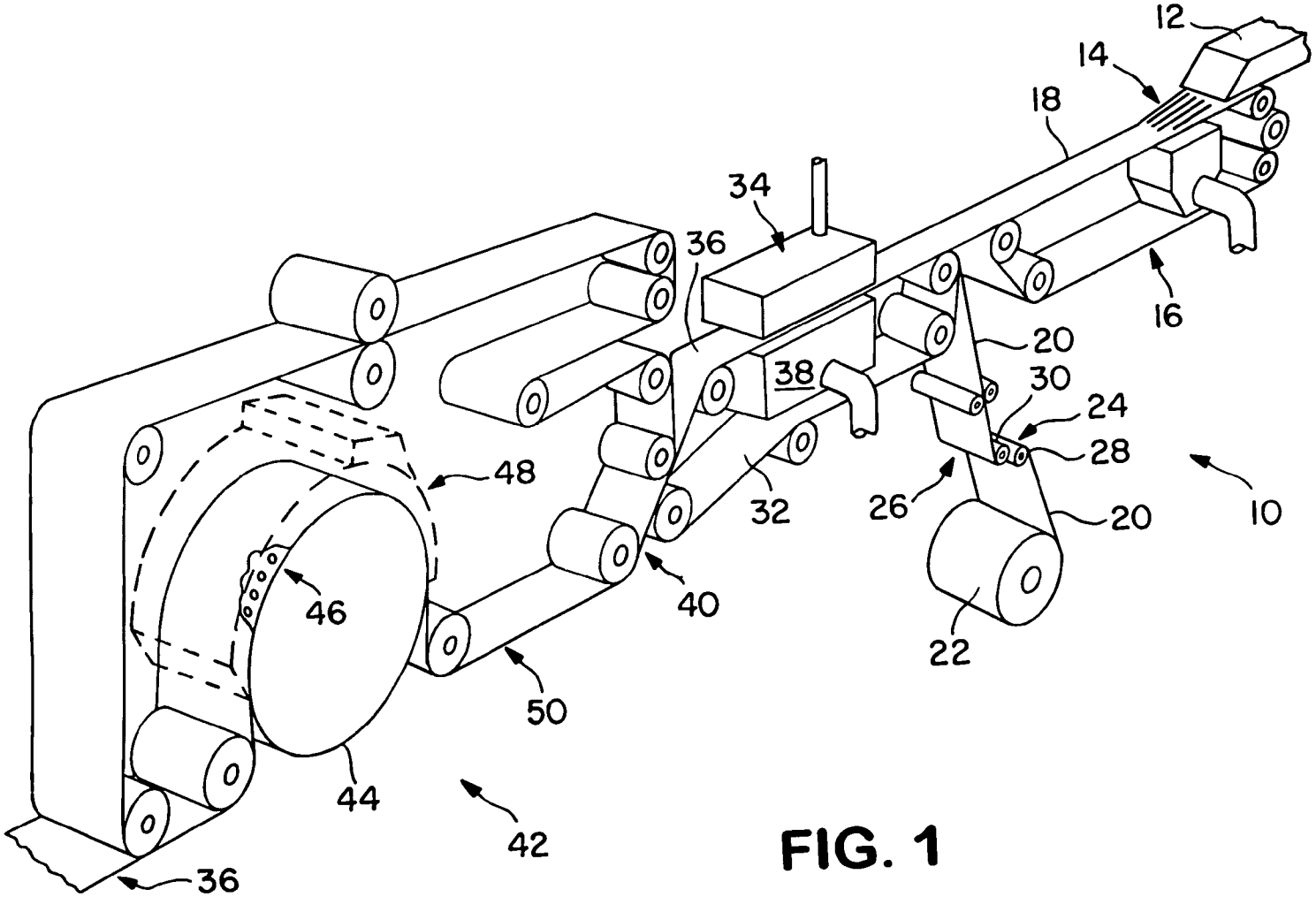
FIG. 1 is a schematic illustration of a process for forming a hydraulically entangled composite fabric in accordance with one embodiment of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

Definitions

As used herein, the term "nonwoven web" refers to a web having a structure of individual fibers or threads that are interlaid, but not in an identifiable manner as in a knitted fabric. Nonwoven webs include, for example, meltblown webs, spunbond webs, carded webs, airlaid webs, etc.

As used herein, the term "spunbond web" refers to a nonwoven web formed from small diameter substantially continuous fibers. The fibers are formed by extruding a molten thermoplastic material as filaments from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often from about 5 to about 20 microns.

As used herein, the term "meltblown web" refers to a nonwoven web formed from fibers extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. In some instances, meltblown fibers may be microfibers that may be continuous or discontinuous, are generally smaller than 10 microns in diameter, and are generally tacky when deposited onto a collecting surface.

As used herein, the term "multicomponent fibers" or "conjugate fibers" refers to fibers that have been formed from at least two polymer components. Such fibers are usually extruded from separate extruders but spun together to form one fiber. The polymers of the respective components are usually different from each other although multicomponent fibers may include separate components of similar or identical polymeric materials. The individual components are typically arranged in substantially constantly positioned distinct zones across the cross-section of the fiber and extend substantially along the entire length of the fiber. The configuration of such fibers may be, for example, a side-by-side arrangement, a pie arrangement, or any other arrangement. Bicomponent fibers and methods of making the same are taught in U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. The fibers and individual components containing the same may also have various irregular shapes such as those described in U.S. Patent. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

As used herein, the term "average fiber length" refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i}^{k} (x_i * n_i)/n$$

wherein, k=maximum fiber length $x_i$=fiber length $n_i$=number of fibers having length $x_i$; and n=total number of fibers measured.

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 millimeters as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to about 1.2 millimeters.

As used herein, the term "high-average fiber length pulp" refers to pulp that contains a relatively small amount of short fibers and non-fiber particles. High-average fiber length pulp is typically formed from certain non-secondary (i.e., virgin) fibers. Secondary fiber pulp that has been screened may also have a high-average fiber length. High-average fiber length pulps typically have an average fiber length of greater than about 1.5 millimeters as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 to about 6 millimeters.

DETAILED DESCRIPTION

In general, the present invention is directed to a nonwoven composite fabric containing one or more surfaces that are abraded (e.g., sanded). In addition to improving the softness and handfeel of the nonwoven composite fabric, it has been unexpectedly discovered that abrading such a fabric may also impart excellent liquid handling properties (e.g., absorbent capacity, absorption rate, wicking rate, etc.), as well as improved bulk and capillary tension.

The nonwoven composite fabric contains absorbent staple fibers and thermoplastic fibers, which is beneficial for a variety of reasons. For example, the thermoplastic fibers of the nonwoven composite fabric may improve strength, durability, and oil absorption properties. Likewise, the absorbent staple fibers may improve bulk, handfeel, and water absorption properties. The relative amounts of the thermoplastic fibers and absorbent staple fibers used in the nonwoven composite fabric may vary depending on the desired properties. For instance, the thermoplastic fibers may comprise less than about 50% by weight of the nonwoven composite fabric, and in some embodiments, from about 10% to about 40% by weight of the nonwoven composite fabric. Likewise, the absorbent staple fibers may comprise greater than about 50% by weight of the nonwoven composite fabric, and in some embodiments, from about 60% to about 90% by weight of the nonwoven composite fabric.

The absorbent staple fibers may be formed from a variety of different materials. For example, in one embodiment, the absorbent staple fibers are non-thermoplastic, and contain cellulosic fibers (e.g., pulp, thermomechanical pulp, synthetic cellulosic fibers, modified cellulosic fibers, and so forth), as well as other types of non-thermoplastic fibers (e.g., synthetic staple fibers). Some examples of suitable cellulosic fiber sources include virgin wood fibers, such as thermomechanical, bleached and unbleached softwood and hardwood pulps. Secondary or recycled fibers, such as obtained from office waste, newsprint, brown paper stock, paperboard scrap, etc., may also be used. Further, vegetable fibers, such as abaca, flax, milkweed, cotton, modified cotton, cotton linters, may also be used. In addition, synthetic cellulosic fibers such as, for example, rayon and viscose rayon may be used. Modified cellulosic fibers may also be used. For example, the absorbent staple fibers may be composed of derivatives of cellulose formed by substitution of appropriate radicals (e.g., carboxyl, alkyl, acetate, nitrate, etc.) for hydroxyl groups along the carbon chain. As stated, non-cellulosic fibers may also be utilized as absorbent staple fibers. Some examples of such absorbent staple fibers include, but are not limited to, acetate staple fibers, Nomex® staple fibers, Kevlar® staple fibers, polyvinyl alcohol staple fibers, lyocel staple fibers, and so forth.

When utilized as absorbent staple fibers, pulp fibers may have a high-average fiber length, a low-average fiber length, or mixtures of the same. Some examples of suitable high-average length pulp fibers include, but are not limited to, northern softwood, southern softwood, redwood, red cedar, hemlock, pine (e.g., southern pines), spruce (e.g., black spruce), combinations thereof, and so forth. Exemplary high-average fiber length wood pulps include those available from the Kimberly-Clark Corporation under the trade designation "Longlac 19". Some examples of suitable low-average fiber length pulp fibers may include, but are not limited to, certain virgin hardwood pulps and secondary (i.e. recycled) fiber pulp from sources such as, for example, newsprint, reclaimed paperboard, and office waste. Hardwood fibers, such as eucalyptus, maple, birch, aspen, and so forth, may also be used as low-average length pulp fibers. Mixtures of high-average fiber length and low-average fiber length pulps may be used. For example, a mixture may contain more than about 50% by weight low-average fiber length pulp and less than about 50% by weight high-average fiber length pulp. One exemplary mixture contains 75% by weight low-average fiber length pulp and about 25% by weight high-average fiber length pulp.

As stated, the nonwoven composite fabric also contains thermoplastic fibers. The thermoplastic fibers may be substantially continuous, or may be staple fibers having an average fiber length of from about 0.1 millimeters to about 25 millimeters, in some embodiments from about 0.5 millimeters to about 10 millimeters, and in some embodiments, from about 0.7 millimeters to about 6 millimeters. Regardless of fiber length, the thermoplastic fibers may be formed from a variety of different types of polymers including, but not limited to, polyolefins, polyamides, polyesters, polyurethanes, blends and copolymers thereof, and so forth. Desirably, the thermoplastic fibers contain polyolefins, and even more desirably, polypropylene and/or polyethylene. Suitable polymer compositions may also have thermoplastic elastomers blended therein, as well as contain pigments, antioxidants, flow promoters, stabilizers, fragrances, abrasive particles, fillers, and so forth. Optionally, multicomponent (e.g., bicomponent) thermoplastic fibers are utilized. For example, suitable configurations for the multicomponent fibers include side-by-side configurations and sheath-core configurations, and suitable sheath-core configurations include eccentric sheath-core and concentric sheath-core configurations. In some embodiments, as is well known in the art, the polymers used to form the multicomponent fibers have sufficiently different melting points to form different crystallization and/or solidification properties. The multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer.

Besides thermoplastic fibers and absorbent staple fibers, the nonwoven composite fabric may also contain various other materials. For instance, small amounts of wet-strength resins and/or resin binders may be utilized to improve strength and abrasion resistance. Debonding agents may also be utilized to reduce the degree of hydrogen bonding. The addition of certain debonding agents in the amount of, for example, about 1% to about 4% percent by weight of a composite layer may also reduce the measured static and dynamic coefficients of friction and improve abrasion resistance. Various other materials such as, for example, activated charcoal, clays, starches, superabsorbent materials, etc., may also be utilized.

In some embodiments, for instance, the nonwoven composite fabric is formed by integrally entangling thermoplastic fibers with absorbent staple fibers using any of a variety of entanglement techniques known in the art (e.g., hydraulic, air, mechanical, etc.). For example, in one embodiment, a nonwoven web formed from thermoplastic fibers is integrally entangled with absorbent staple fibers using hydraulic entanglement. A typical hydraulic entangling process utilizes high pressure jet streams of water to entangle fibers and/or filaments to form a highly entangled consolidated composite structure. Hydraulic entangled nonwoven composite materials are disclosed, for example, in U.S. Pat. No. 3,494,821 to Evans; U.S. Pat. No. 4,144,370 to Bouolton; U.S. Pat. No. 5,284,703 to Everhart, et al.; and U.S. Pat. No. 6,315,864 to Anderson, et al., which are incorporated herein in their entirety by reference thereto for all purposes.

Referring to FIG. 1, for instance, one embodiment of a hydraulic entangling process suitable for forming a nonwoven composite fabric from a nonwoven web and pulp fibers is illustrated. As shown, a fibrous slurry containing pulp fibers is conveyed to a conventional papermaking headbox 12 where it is deposited via a sluice 14 onto a conventional forming fabric or surface 16. The suspension of pulp fibers may have any consistency that is typically used in conventional papermaking processes. For example, the suspension may contain from about 0.01 to about 1.5 percent by weight pulp fibers suspended in water. Water is then removed from the suspension of pulp fibers to form a uniform layer 18 of the pulp fibers.

A nonwoven web 20 is also unwound from a rotating supply roll 22 and passes through a nip 24 of a S-roll arrangement 26 formed by the stack rollers 28 and 30. Any of a variety of techniques may be used to form the nonwoven web 20. For instance, in one embodiment, staple fibers are used to form the nonwoven web 20 using a conventional carding process, e.g., a woolen or cotton carding process. Other processes, however, such as air laid or wet laid processes, may also be used to form a staple fiber web. In addition, substantially continuous fibers may be used to form the nonwoven web 20, such as those formed by melt-spinning process, such as spunbonding, meltblowing, etc.

The nonwoven web 20 may be bonded to improve its durability, strength, hand, aesthetics and/or other properties. For instance, the nonwoven web 20 may be thermally, ultrasonically, adhesively and/or mechanically bonded. As an example, the nonwoven web 20 may be point bonded such that it possesses numerous small, discrete bond points. An exemplary point bonding process is thermal point bonding, which generally involves passing one or more layers between heated rolls, such as an engraved patterned roll and a second bonding roll. The engraved roll is patterned in some way so that the web is not bonded over its entire surface, and the second roll may be smooth or patterned. As a result, various patterns for engraved rolls have been developed for functional as well as aesthetic reasons. Exemplary bond patterns include, but are not limited to, those described in U.S. Pat. No. 3,855,046 to Hansen, et al., U.S. Pat. No. 5,620,779 to Levy, et al., U.S. Pat. No. 5,962,112 to Haynes, et al., U.S. Pat. No. 6,093,665 to Sayovitz, et al., U.S. Design Pat. No. 428,267 to Romano, et al. and U.S. Design Pat. No. 390,708 to Brown, which are incorporated herein in their entirety by reference thereto for all purposes. For instance, in some embodiments, the nonwoven web 20 may be optionally bonded to have a total bond area of less than about 30% (as determined by conventional optical microscopic methods) and/or a uniform bond density greater than about 100 bonds per square inch. For example, the nonwoven web may have a total bond area from about 2% to about 30% and/or a bond density from about 250 to about 500 pin bonds per square inch. Such a combination of total bond area and/or bond density may, in some embodiments, be achieved by bonding the nonwoven web 20 with a pin bond pattern having more than about 100 pin bonds per square inch that provides a total bond surface area less than about 30% when fully contacting a smooth anvil roll. In some embodiments, the bond pattern may have a pin bond density from about 250 to about 350 pin bonds per square inch and/or a total bond surface area from about 10% to about 25% when contacting a smooth anvil roll.

Further, the nonwoven web 20 may be bonded by continuous seams or patterns. As additional examples, the nonwoven web 20 may be bonded along the periphery of the sheet or simply across the width or cross-direction (CD) of the web adjacent the edges. Other bond techniques, such as a combination of thermal bonding and latex impregnation, may also be used. Alternatively and/or additionally, a resin, latex or adhesive may be applied to the nonwoven web 20 by, for example, spraying or printing, and dried to provide the desired bonding. Still other suitable bonding techniques may be described in U.S. Pat. No. 5,284,703 to Everhart, et al., U.S. Pat. No. 6,103,061 to Anderson, et al., and U.S. Pat. No. 6,197,404 to Varona, which are incorporated herein in its entirety by reference thereto for all purposes.

Returning again to FIG. 1, the nonwoven web 20 is then placed upon a foraminous entangling surface 32 of a conventional hydraulic entangling machine where the pulp fiber layer 18 are then laid on the web 20. Although not required, it is typically desired that the pulp fiber layer 18 be positioned between the nonwoven web 20 and the hydraulic entangling manifolds 34. The pulp fiber layer 18 and the nonwoven web 20 pass under one or more hydraulic entangling manifolds 34 and are treated with jets of fluid to entangle the pulp fiber layer 18 with the fibers of the nonwoven web 20, and drive them into and through the nonwoven web 20 to form a nonwoven composite fabric 36. Alternatively, hydraulic entangling may take place while the pulp fiber layer 18 and the nonwoven web 20 are on the same foraminous screen (e.g., mesh fabric) that the wet-laying took place. The present invention also contemplates superposing a dried pulp fiber layer 18 on the nonwoven web 20, rehydrating the dried sheet to a specified consistency and then subjecting the rehydrated sheet to hydraulic entangling. The hydraulic entangling may take place while the pulp fiber layer 18 is highly saturated with water. For example, the pulp fiber layer 18 may contain up to about 90% by weight water just before hydraulic entangling. Alternatively, the pulp fiber layer 18 may be an air-laid or dry-laid layer.

Hydraulic entangling may be accomplished utilizing conventional hydraulic entangling equipment such as described in, for example, in U.S. Pat. No. 5,284,703 to Everhart, et al. and U.S. Pat. No. 3,485,706 to Evans, which are incorporated herein in their entirety by reference thereto for all purposes. Hydraulic entangling may be carried out with any appropriate working fluid such as, for example, water. The working fluid flows through a manifold that evenly distributes the fluid to a series of individual holes or orifices. These holes or orifices may be from about 0.003 to about 0.015 inch in diameter and may be arranged in one or more rows with any number of orifices, e.g., 30–100 per inch, in each row. For example, a manifold produced by Fleissner, Inc. of Charlotte, N.C., containing a strip having 0.007-inch diameter orifices, 30 holes per inch, and 1 row of holes may be utilized. However, it should also be understood that many other manifold configurations and combinations may be used. For example, a single manifold may be used or several manifolds may be arranged in succession. Moreover, although not required, the fluid pressure typically used during hydraulic entangling ranges from about 1000 to about 3000 psig, and in some embodiments, from about 1200 to about 1800 psig. For instance, when processed at the upper ranges of the described pressures, the nonwoven composite fabric 36 may be processed at speeds of up to about 1000 feet per minute (fpm).

Fluid may impact the pulp fiber layer 18 and the nonwoven web 20, which are supported by a foraminous surface, such as a single plane mesh having a mesh size of from about 40×40 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled nonwoven composite fabric 36.

Although not held to any particular theory of operation, it is believed that the columnar jets of working fluid that directly impact the pulp fiber layer 18 laying on the nonwoven web 20 work to drive the pulp fibers into and partially through the matrix or network of fibers in the nonwoven web 20. When the fluid jets and the pulp fiber layer 18 interact with the nonwoven web 20, the pulp fibers of the layer 18 are also entangled with the fibers of the nonwoven web 20 and with each other. In some embodiments, such entanglement may result in a material having a "sidedness" in that one surface has a preponderance of the thermoplastic fibers, giving it a slicker, more plastic-like feel, while another surface has a preponderance of pulp fibers, giving it a softer, more consistent feel. That is, although the pulp fibers of the layer 18 are driven through and into the matrix of the nonwoven web 20, many of the pulp fibers will still remain at or near a surface of the material 36. This surface may thus contain a greater proportion of pulp fibers, while the other surface may contain a greater proportion of the thermoplastic fibers of the nonwoven web 20.

After the fluid jet treatment, the resulting nonwoven composite fabric 36 may then be transferred to a drying operation (e.g., compressive, non-compressive, etc.). A differential speed pickup roll may be used to transfer the material from the hydraulic needling belt to the drying operation. Alternatively, conventional vacuum-type pickups and transfer fabrics may be used. If desired, the nonwoven composite fabric 36 may be wet-creped before being transferred to the drying operation. Non-compressive drying of the material 36, for instance, may be accomplished utilizing a conventional through-dryer 42. The through-dryer 42 may be an outer rotatable cylinder 44 with perforations 46 in combination with an outer hood 48 for receiving hot air blown through the perforations 46. A through-dryer belt 50 carries the nonwoven composite fabric 36 over the upper portion of the through-dryer outer cylinder 40. The heated air forced through the perforations 46 in the outer cylinder 44 of the through-dryer 42 removes water from the nonwoven composite fabric 36. The temperature of the air forced through the nonwoven composite fabric 36 by the through-dryer 42 may range from about 200° F. to about 500° F. Other useful through-drying methods and apparatuses may be found in, for example, U.S. Pat. No. 2,666,369 to Niks and U.S. Pat. No. 3,821,068 to Shaw, which are incorporated herein in their entirety by reference thereto for all purposes.

In addition to a hydraulically entangled nonwoven composite fabric, the nonwoven composite fabric may also contain a blend of thermoplastic fibers and absorbent staple fibers. For instance, the nonwoven composite fabric may be a "coform" material, which may be made by a process in which at least one meltblown die head is arranged near a chute through which absorbent staple fibers are added to the nonwoven web while it forms. Some examples of such coform materials are disclosed in U.S. Pat. No. 4,100,324 to Anderson, et al.; U.S. Pat. No. 5,284,703 to Everhart, et al.; and U.S. Pat. No. 5,350,624 to Georger, et al.; which are incorporated herein in their entirety by reference thereto for all purposes.

Regardless of the manner in which it is formed, the composite fabric is subjected to an abrasive finishing process in accordance with the present invention to enhance certain of its properties. Various well-known abrasive finishing processes may generally be performed, including, but not limited to, sanding, napping, and so forth. For instance, several suitable sanding processes are described in U.S. Pat. No. 6,269,525 to Dischler, et al.; U.S. Pat. No. 6,260,247 to Dischler, et al.; U.S. Pat. No. 6,112,381 to Dischler, et al.; U.S. Pat. No. 5,662,515; to Evensen; U.S. Pat. No. 5,564,971 to Evensen; U.S. Pat. No. 5,531,636 to Bissen; U.S. Pat. No. 5,752,300 to Dischler, et al.; U.S. Pat. No. 5,815,896 to Dischler, et al.; U.S. Pat. No. 4,512,065 to Otto; U.S. Pat. No. 4,468,844 to Otto; and U.S. Pat. No. 4,316,928 to Otto, which are incorporated herein in their entirety by reference thereto for all purposes. Some examples of sanders suitable for use in the present invention include the 450 Series, 620 Series, and 710 Series Microgrinders available from Curtin-Hebert Co., Inc. of Gloversville, N.Y.

Figure 2:
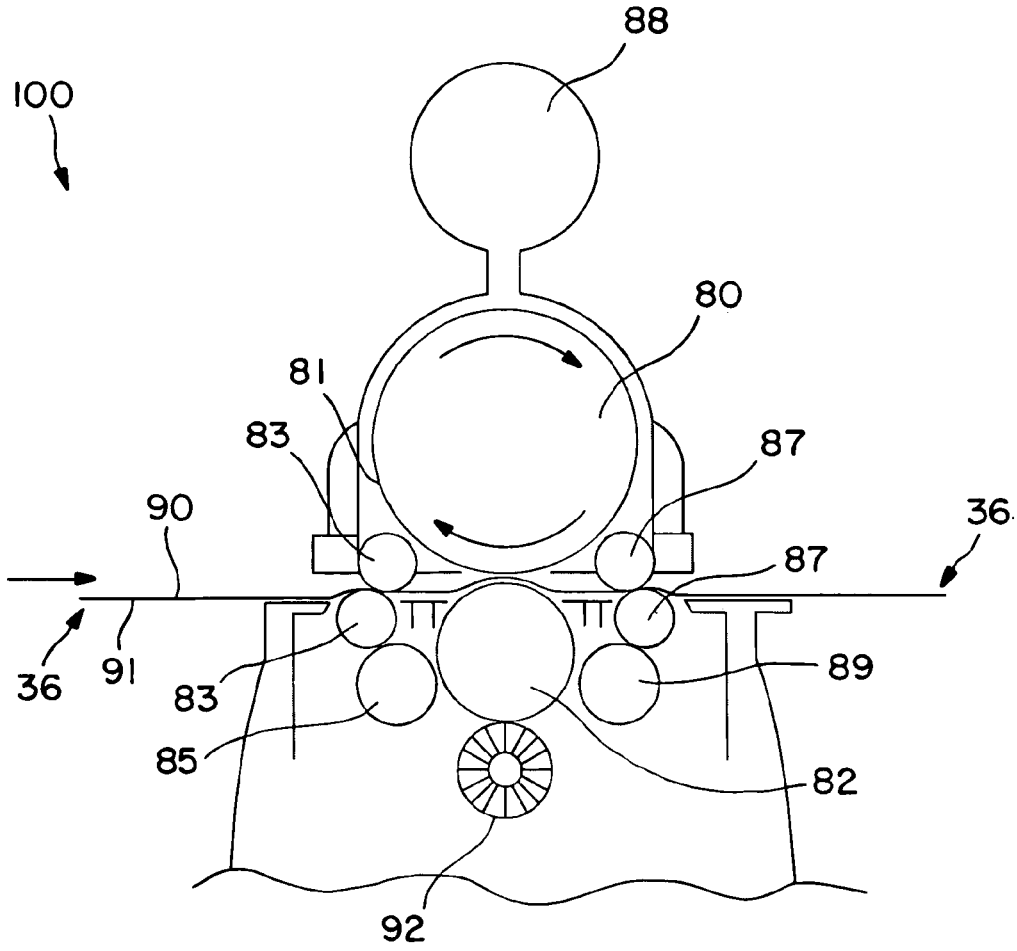
FIG. 2 is a schematic illustration of a process for abrading a composite fabric in accordance with one embodiment of the present invention.

For exemplary purposes only, one embodiment of a suitable abrasion system 100 is shown in FIG. 2. As shown, the abrasion system 100 includes two pinch rolls 83 through which a composite fabric 36 is supplied. A drive roll 85 actuates movement of the pinch rolls 83 in the desired direction. Once the composite fabric 36 passes through the pinch rolls 83, it then passes between an abrasion roll 80 and a pressure roll 82. At least a portion of a surface 81 of the abrasion roll 80 is covered with an abrasive material, such as sandpaper or sanding cloth, so that abrasion results when the pressure roll 82 impresses a surface 90 of the composite fabric 36 against the surface 81 of the abrasion roll 80. Generally speaking, the abrasion roll 80 rotates in either a counterclockwise or clockwise direction. In this manner, the abrasion roll 80 may impart the desired abrasive action to the surface 90 of the composite fabric 36. The abrasion roll 80 may rotate in a direction opposite to that of the composite fabric 36 to optimize abrasion. That is, the abrasion roll 80 may rotate so that the direction tangent to the abrasive surface 81 at the point of contact with the composite fabric 36 is opposite to the linear direction of the moving fabric 36. In the illustrated embodiment, for example, the direction of roll rotation is clockwise, and the direction of fabric movement is from left to right.

The abrasion system 80 may also include an exhaust system 88 that uses vacuum forces to remove any debris remaining on the surface 90 of the composite fabric 36 after the desired level of abrasion. A brush roll 92 may also be utilized to clean the surface of the pressure roll 82. Once abraded, the composite fabric 36 then leaves the sander via pinch rolls 87, which are actuated by a drive roll 89.

As described above, the composite fabric 36 may sometimes have a "sidedness" with one surface having a preponderance of staple fibers (e.g., pulp fibers). In one embodiment, the surface 90 of the composite fabric 36 that is abraded may contain a preponderance of staple fibers. In addition, the surface 90 may contain a preponderance of thermoplastic fibers from the nonwoven web. The present inventors have surprisingly discovered that, apart from improving softness and handfeel, abrading one or more surfaces may also enhance other physical properties of the fabric, such as bulk, absorption rate, wicking rate, and absorption capacity. Although not intending to be limited by theory, the abrasive surface combs, naps, and/or raises the surface fibers with which it contacts. Consequently, the fibers are mechanically re-arranged and somewhat pulled out from the matrix of the composite material. These raised fibers may be, for instance, pulp fibers and/or thermoplastic fibers. Regardless, the fibers on the surface exhibit a more uniform appearance and enhance the handfeel of the fabric, creating a more "cloth like" material.

Regardless of the nature of the surface abraded, the extent that the properties of the composite fabric 36 are modified by the abrasion process depends on a variety of different factors, such as the size of the abrasive material, the force and frequency of roll contact, etc. For example, the type of an abrasive material used to cover the abrasion roll 80 may be selectively varied to achieve the desired level of abrasion. For example, the abrasive material may be formed from a matrix embedded with hard abrasive particles, such as diamond, carbides, borides, nitrides of metals and/or silicon. In one embodiment, diamond abrasive particles are embedded within a plated metal matrix (e.g., nickel or chromium), such as described in U.S. Pat. No. 4,608,128 to Farmer, which is incorporated herein in its entirety by reference thereto for all purposes. Abrasive particles with a smaller particle size tend to abrade surfaces to a lesser extent than those having a larger particle size. Thus, the use of larger particle sizes may be more suitable for higher weight fabrics. However, abrasive particles with too large a particle size may abrade the composite fabric 36 to such an extent that it destroys certain of its physical characteristics. To balance these concerns, the average particle size of the abrasive particles may range from about 1 to about 1000 microns, in some embodiments from about 20 to about 200 microns, and in some embodiments, from about 30 to about 100 microns.

Likewise, a greater force and/or frequency of contact with the abrasion roll 80 may also result in greater level of abrasion. Various factors may impact the force and frequency of roll contact. For example, the linear speed of the composite fabric 36 relative to the abrasion roll 80 may vary, with higher linear speeds generally corresponding to a higher level of abrasion. In most embodiments, the linear speed of the composite fabric 36 ranges from about 100 to about 4000 feet per minute, in some embodiments from about 500 to about 3400 feet per minute, and in some embodiments, from about 1500 to about 3000 feet per minute. In addition, the abrasion roll 80 typically rotates at speeds from about 100 to about 8,000 revolutions per minute (rpms), in some embodiments from about 500 to about 6,000 rpms, and in some embodiments, from about 1,000 to about 4,000 rpms. If desired, a speed differential exist between the composite fabric 36 and the abrasion roll 80 to improve the abrasion process.

The distance between the pressure roll 82 and the abrasion roll 80 (i.e., "gap") may also affect the level of abrasiveness, with smaller distances generally resulting in a greater level of abrasion. For example, the distance between the pressure roll 82 and the abrasion roll 80 may, in some embodiments, range from about 0.001 inches to about 0.1 inches, in some embodiments from about 0.01 inches to about 0.05 inches, and in some embodiments, from about 0.01 inches to about 0.02 inches.

One or more of the above-mentioned characteristics may be selectively varied to achieve the desired level of surface abrasion. For example, when abrasive particles having a very larger particle size are used, it may be desired to select a relatively low rotation speed for the abrasion roll 80 to achieve a certain level of abrasion without destroying physical characteristics of the composite fabric 36. In addition, the composite fabric 36 may also contact multiple abrasive rolls 80 to achieve the desired results. Different particle sizes may be employed for the different abrasive rolls 80 in different sequences to accomplish specific effects. For example, it may be desired to pre-treat the composite fabric 36 with an abrasive roll having a larger particle size (coarse) to make the fabric surface more easily alterable by smaller particle sizes (fine) at subsequent abrasive rolls. In addition, multiple abrasive rolls may also be used to abrade multiple surfaces of the composite fabric 36. For instance, in one embodiment, a surface 91 of the composite fabric 36 may be abraded within an abrasive roll before, after, and/or simultaneous to the abrasion of the surface 90.

Figure 3:
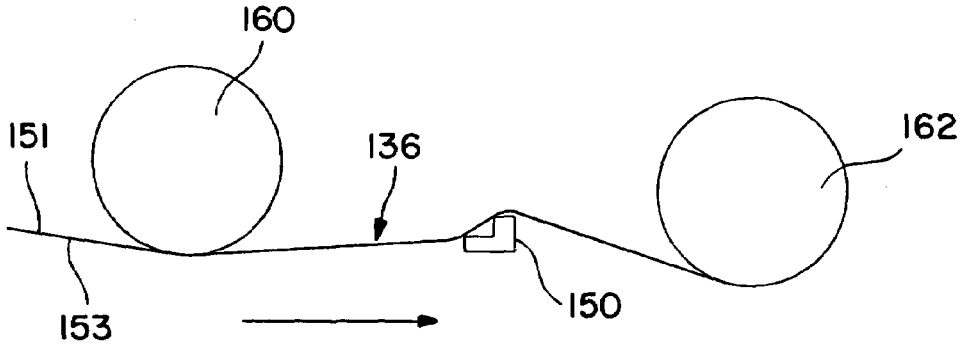
FIG. 3 is a schematic illustration of a process for abrading a composite fabric in accordance with another embodiment of the present invention.
Figure 4:
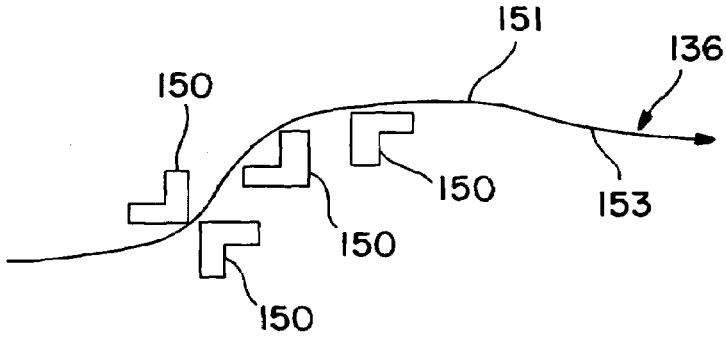
FIG. 4 is a schematic illustration of a process for abrading a composite fabric in accordance with another embodiment of the present invention.
Figure 5:
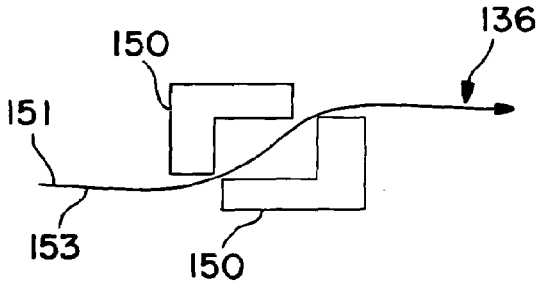
FIG. 5 is a schematic illustration of a process for abrading a composite fabric in accordance with another embodiment of the present invention.

It should be understood that the present invention is not limited to rolls covered with abrasive particles, but may include any other technique for abrading the surface of a fabric. For example, stationary bars may be used to impart the desired level of abrasion. These bars may be formed from a variety of materials, such as steel, and configured to have an abrasive surface. Referring to FIGS. 3–5, various embodiments of a method for abrading a composite fabric 136 using stationary bars are illustrated. In FIG. 3, for example, a surface 153 of the composite fabric 136 moving in the indicated direction is abraded by a stationary bar 150 as it is unwound from a roll 160 and wound onto a roll 162. The stationary bar 150 may inherently possess an abrasive surface, or may be provided with an abrasive surface, such as by wrapping the bar 150 with a substrate containing abrasive particles. Although not shown, various tensioning rolls, etc., may guide the composite fabric 136 as it traverses over the stationary bar 150. FIGS. 4 and 5 illustrate similar embodiments in which multiple stationary bars 150 are used to abrade the composite fabric 136. In FIG. 4, the surface 153 of the composite fabric 136 is abraded with a single stationary bar 150 and the surface 151 is abraded using three (3) other stationary bars 150. Similarly, in FIG. 5, each surface 151 and 153 of the composite fabric 136 is abraded using two (2) breaker bars.

In another embodiment, the composite fabric 36 may be napped by contacting its surface with a roll covered with uniformly spaced wires. The wires are normally fine, flexible wires. It may also be advantageous to embed the wires in a support substrate so that their tips protrude only slightly therefrom. Such a support substrate may be formed from a compressible material, such as foam rubber, soft rubber, felt, and so forth, so that it is compressed during impact. The degree of compression determines the extent to which the wire tips protrude from the surface, and thus the extent that the napping wire tips penetrate into the composite fabric 36. Besides the presence of wires, such a napping roll may be otherwise similar to the abrasion roll 80 described above with respect to FIG. 2.

Before or after abrading the composite fabric 36, it may also be desirable to use other finishing steps and/or post treatment processes to impart selected properties to the composite fabric 36. For example, the composite fabric 36 may be lightly pressed by calender rolls, or otherwise treated to enhance stretch and/or to provide a uniform exterior appearance and/or certain tactile properties. Alternatively or additionally, various chemical post-treatments such as, adhesives or dyes may be added to the composite fabric 36. Additional post-treatments that may be utilized are described in U.S. Pat. No. 5,853,859 to Levy, et al., which is incorporated herein in its entirety by reference thereto for all purposes. Further, the abraded surface of the composite fabric 36 may be vacuumed to remove any fibers that became free during the abrasion process.

The composite fabric of the present invention is particularly useful as a wiper. The wiper may have a basis weight of from about 20 grams per square meter ("gsm") to about 300 gsm, in some embodiments from about 30 gsm to about 200 gsm, and in some embodiments, from about 50 gsm to about 150 gsm. Lower basis weight products are typically well suited for use as light duty wipers, while higher basis weight products are well suited as industrial wipers. The wipers may also have any size for a variety of wiping tasks. The wiper may also have a width from about 8 centimeters to about 100 centimeters, in some embodiments from about 10 to about 50 centimeters, and in some embodiments, from about 20 centimeters to about 25 centimeters. In addition, the wiper may have a length from about 10 centimeters to about 200 centimeters, in some embodiments from about 20 centimeters to about 100 centimeters, and in some embodiments, from about 35 centimeters to about 45 centimeters.

If desired, the wiper may also be pre-moistened with a liquid, such as water, a waterless hand cleanser, or any other suitable liquid. The liquid may contain antiseptics, fire retardants, surfactants, emollients, humectants, and so forth. In one embodiment, for example, the wiper may be applied with a sanitizing formulation, such as described in U.S. Patent Application Publication No. 2003/0194932 to Clark, et al., which is incorporated herein in its entirety by reference thereto for all purposes. The liquid may be applied by any suitable method known in the art, such as spraying, dipping, saturating, impregnating, brush coating and so forth. The amount of the liquid added to the wiper may vary depending upon the nature of the composite fabric, the type of container used to store the wipers, the nature of the liquid, and the desired end use of the wipers. Generally, each wiper contains from about 150 to about 600 wt. %, and in some embodiments, from about 300 to about 500 wt. % of the liquid based on the dry weight of the wiper.

In one embodiment, the wipers are provided in a continuous, perforated roll. Perforations provide a line of weakness by which the wipers may be more easily separated. For instance, in one embodiment, a 6" high roll contains 12" wide wipers that are v-folded. The roll is perforated every 12 inches to form 12"×12" wipers. In another embodiment, the wipers are provided as a stack of individual wipers. The wipers may be packaged in a variety of forms, materials and/or containers, including, but not limited to, rolls, boxes, tubs, flexible packaging materials, and so forth. For example, in one embodiment, the wipers are inserted on end in a selectively resealable container (e.g., cylindrical). Some examples of suitable containers include rigid tubs, film pouches, etc. One particular example of a suitable container for holding the wipers is a rigid, cylindrical tub (e.g., made from polyethylene) that is fitted with a re-sealable air-tight lid (e.g., made from polypropylene) on the top portion of the container. The lid has a hinged cap initially covering an opening positioned beneath the cap. The opening allows for the passage of wipers from the interior of the sealed container whereby individual wipers may be removed by grasping the wiper and tearing the seam off each roll. The opening in the lid is appropriately sized to provide sufficient pressure to remove any excess liquid from each wiper as it is removed from the container.

Other suitable wiper dispensers, containers, and systems for delivering wipers are described in U.S. Pat. No. 5,785,179 to Buczwinski, et al.; U.S. Pat. No. 5,964,351 to Zander; U.S. Pat. No. 6,030,331 to Zander; U.S. Pat. No. 6,158,614 to Haynes, et al.; U.S. Pat. No. 6,269,969 to Huang, et al.; U.S. Pat. No. 6,269,970 to Huang, et al.; and U.S. Pat. No. 6,273,359 to Newman, et al., which are incorporated herein in their entirety by reference thereto for all purposes.

The present invention may be better understood with reference to the following examples.

Test Methods

The following test methods are utilized in the examples.

Bulk: The bulk of a fabric corresponds to its thickness. The bulk was measured in the example in accordance with TAPPI test methods T402 "Standard Conditioning and Testing Atmosphere For Paper, Board, Pulp Handsheets and Related Products" or T411 om-89 "Thickness (caliper) of Paper, Paperboard, and Combined Board" with Note 3 for stacked sheets. The micrometer used for carrying out T411 om-89 can be an Emveco Model 200A Electronic Microgage (made by Emveco, Inc. of Newberry, Oreg.) having an anvil diameter of 57.2 millimeters and an anvil pressure of 2 kilopascals.

Grab Tensile Strength: The grab tensile test is a measure of breaking strength of a fabric when subjected to unidirectional stress. This test is known in the art and conforms to the specifications of Method 5100 of the Federal Test Methods Standard 191A. The results are expressed in pounds to break. Higher numbers indicate a stronger fabric. The grab tensile test uses two clamps, each having two jaws with each jaw having a facing in contact with the sample. The clamps hold the material in the same plane, usually vertically, separated by 3 inches (76 mm) and move apart at a specified rate of extension. Values for grab tensile strength are obtained using a sample size of 4 inches (102 mm) by 6 inches (152 mm), with a jaw facing size of 1 inch (25 mm) by 1 inch, and a constant rate of extension of 300 mm/min. The sample is wider than the clamp jaws to give results representative of effective strength of fibers in the clamped width combined with additional strength contributed by adjacent fibers in the fabric. The specimen is clamped in, for example, a Sintech 2 tester, available from the Sintech Corporation of Cary, N.C., an Instron Model TM, available from the Instron Corporation of Canton, Mass., or a Thwing-Albert Model INTELLECT II available from the Thwing-Albert Instrument Co. of Philadelphia, Pa. This closely simulates fabric stress conditions in actual use. Results are reported as an average of three specimens and may be performed with the specimen in the cross direction (CD) or the machine direction (MD).

Water Intake Rate: The intake rate of water is the time required, in seconds, for a sample to completely absorb the liquid into the web versus sitting on the material surface. Specifically, the intake of water is determined according to ASTM No. 2410 by delivering 0.5 cubic centimeters of water with a pipette to the material surface. Four (4) 0.5-cubic centimeter drops of water (2 drops per side) are applied to each material surface. The average time for the four drops of water to wick into the material (z-direction) is recorded. Lower absorption times, as measured in seconds, are indicative of a faster intake rate. The test is run at conditions of 73.4°±3.6° F. and 50%±5% relative humidity.

Oil Intake Rate: The intake rate of oil is the time required, in seconds, for a sample to absorb a specified amount of oil. The intake of motor oil is determined in the same manner described above for water, except that 0.1 cubic centimeters of oil is used for each of the four (4) drops (2 drops per side).

Absorption Capacity: The absorption capacity refers to the capacity of a material to absorb a liquid (e.g., water or motor oil) over a period of time and is related to the total amount of liquid held by the material at its point of saturation. The absorption capacity is measured in accordance with Federal Specification No. UU-T-595C on industrial and institutional towels and wiping papers. Specifically, absorption capacity is determined by measuring the increase in the weight of the sample resulting from the absorption of a liquid and is expressed, in percent, as the weight of liquid absorbed divided by the weight of the sample by the following equation:

$$\text{Absorption Capacity}=[(\text{saturated sample weight}-\text{sample weight})/\text{sample weight}]\times 100.$$

Taber Abrasion Resistance: Taber Abrasion resistance measures the abrasion resistance in terms of destruction of the fabric produced by a controlled, rotary rubbing action. Abrasion resistance is measured in accordance with Method 5306, Federal Test Methods Standard No. 191A, except as otherwise noted herein. Only a single wheel is used to abrade the specimen. A 12.7×12.7-cm specimen is clamped to the specimen platform of a Taber Standard Abrader (Model No. 504 with Model No. E-140-15 specimen holder) having a rubber wheel (No. H-18) on the abrading head and a 500-gram counterweight on each arm. The loss in breaking strength is not used as the criteria for determining abrasion resistance. The results are obtained and reported in abrasion cycles to failure where failure was deemed to occur at that point where a 0.5-cm hole is produced within the fabric.

Drape Stiffness: The "drape stiffness" test measures the resistance to bending of a material. The bending length is a measure of the interaction between the material weight and stiffness as shown by the way in which the material bends under its own weight, in other words, by employing the principle of cantilever bending of the composite under its own weight. In general, the sample was slid at 4.75 inches per minute (12 cm/min), in a direction parallel to its long dimension, so that its leading edge projected from the edge of a horizontal surface. The length of the overhang was measured when the tip of the sample was depressed under its own weight to the point where the line joining the tip to the edge of the platform made a 41.50° angle with the horizontal. The longer the overhang, the slower the sample was to bend; thus, higher numbers indicate stiffer composites. This method conforms to specifications of ASTM Standard Test D 1388. The drape stiffness, measured in inches, is one-half of the length of the overhang of the specimen when it reaches the 41.50° slope. The test samples were prepared as follows. Samples were cut into rectangular strips measuring 1 inch (2.54 cm) wide and 6 inches (15.24 cm) long. Specimens of each sample were tested in the machine direction and cross direction. A suitable Drape-Flex Stiffness Tester, such as FRL-Cantilever Bending Tester, Model 79-10 available from Testing Machines Inc., located in Amityville, N.Y., was used to perform the test.

Gelbo Lint: The amount of lint for a given sample was determined according to the Gelbo Lint Test. The Gelbo Lint Test determines the relative number of particles released from a fabric when it is subjected to a continuous flexing and twisting movement. It is performed in accordance with INDA test method 160.1-92. A sample is placed in a flexing chamber. As the sample is flexed, air is withdrawn from the chamber at 1 cubic foot per minute for counting in a laser particle counter. The particle counter counts the particles by size for less than or greater than a certain particle size (e.g., 25 microns) using channels to size the particles. The results may be reported as the total particles counted over 10 consecutive 30-second periods, the maximum concentration achieved in one of the ten counting periods or as an average of the ten counting periods. The test indicates the lint generating potential of a material.

EXAMPLE 1

Wypall® X80 Red wipers and Wypall® X80 Blue Steel wipers, which are commercially available from Kimberly-Clark Corporation, were provided. The wipers were formed from nonwoven composite materials in substantial accordance with U.S. Pat. No. 5,284,703 to Everhart, et al. Specifically, the wipers had a basis weight of 125 grams per square meter (gsm), and were formed from a spunbond polypropylene web (22.7 gsm) hydraulically entangled with northern softwood kraft fibers.

The wipers were abraded under various conditions using a 620 Series microgrinder obtained from Curtin-Hebert Co., Inc. of Gloversville, N.Y., which is substantially similar to the device shown in FIG. 2. Specifically, each wiper was first abraded on its pulp-side and tested for various properties (1 pass). Thereafter, the spunbond-side of the wipers was abraded (2 pass) using the identical abrasion conditions. The abrasion roll in each pass oscillated 0.25 inches in the cross-direction of the samples to ensure that the roll did not become filled with fibers and that grooves were not worn into the roll.

The abrasion conditions for each pass are set forth below in Table 1:

TABLE 1

| Abrasion Conditions | | | |
|---|---|---|---|
| Processing Condition | Units | Wypall ® X80 Red Wiper | Wypall ® X80 Blue Wiper |
| Width In | Inches | 50 | 50 |
| Width Out (1 pass) | Inches | 49 | 49 |
| Width Out (2 pass) | Inches | 49 | 48 |
| Linear Feet | — | 22500 | 22500 |
| Line Speed | Feet per minute | 17 | 17 |
| Gap | Inches | 0.014 | 0.014 |
| Average Particle Size (microns) | Microns | 122 | 122 |
| Abrasive Roll Speed | Feet per minute | 2700 | 2700 |
| Abrasive Roll Oscillation | Inches | 0.25 | 0.25 |
| Abrasive Roll Diameter | Inches | 30 | 30 |
| Pressure Roll Type | — | Steel | Steel |

Once abraded, various properties of the wipers were then tested. Control samples were also tested that were not abraded according to the present invention. Table 2 sets forth the results obtained for the Wypall® X80 Red wiper and Table 3 sets for the results obtained for the Wypall® X80 Steel Blue wiper.

TABLE 2

Properties of the Wypall ® X80 Red Wiper

| Physical Property (Average) | Units | Control | std dev | 1-pass | std dev | 2 pass | std dev |
|---|---|---|---|---|---|---|---|
| Basis Weight | gsm | 128.1 | — | 122.87 | — | 123.1 | — |
| Bulk | inches | 0.024 | 0.001 | 0.026 | 0 | 0.028 | 0.001 |
| Motor Oil Rate (50 weight) | seconds | 180.0 | 0.0 | 87.1 | 8.7 | 66.3 | 13.4 |
| Motor Oil Capacity (50 weight) | % | 387.0 | 27.5 | 608.0 | 65.9 | 608.4 | 65.9 |
| Water Rate | seconds | 5.1 | 0.3 | 3.7 | 0.3 | 3.9 | 0.0 |
| Water Capacity | % | 356.5 | 9.9 | 439.6 | 11.3 | 478.6 | 8.9 |
| Taber Abrasion, Pulp dry | cycles | 204.0 | 20.3 | 230.0 | 26.1 | 225.2 | 48.9 |
| Taber Abrasion, Pulp wet | cycles | 377.6 | 57.7 | 298.0 | 54.7 | 258.8 | 56.3 |
| Drape CD | centimeters | 2.7 | 0.3 | 2.8 | 0.2 | 2.5 | 0.4 |
| Drape MD | centimeters | 5.3 | 0.3 | 3.6 | 0.2 | 4.9 | 0.3 |
| Grab Tensile MD Dry | pounds | 32.6 | 2.2 | 29.0 | 1.8 | 24.1 | 1.5 |
| Grab Tensile MD Wet | pounds | 28.7 | 1.7 | 28.0 | 3.2 | 24.0 | 1.7 |
| Grab Tensile CD Dry | pounds | 17.3 | 0.7 | 14.7 | 1.3 | 13.5 | 0.5 |
| Grab Tensile CD Wet | pounds | 18.2 | 1.0 | 15.6 | 1.3 | 12.1 | 1.4 |
| Gelbo Lint Count | >5 microns | 209.0 | 68.4 | 279.6 | 74.6 | 99.6 | 31.4 |
| Gelbo Lint Count | >10 microns | 144.8 | 42.7 | 151.8 | 58.6 | 45.4 | 13.0 |
| Gelbo Lint Count | >25 microns | 53.0 | 12.6 | 59.2 | 24.9 | 15.2 | 6.7 |
| Gelbo Lint Count | >50 microns | 13.0 | 4.7 | 20.6 | 9.9 | 4.6 | 3.4 |
| Gelbo Lint Count | >65 microns | 5.2 | 2.4 | 14.0 | 7.3 | 3.6 | 2.9 |
| Gelbo Lint Count | >80 microns | 2.4 | 1.5 | 7.2 | 3.7 | 1.8 | 0.8 |

TABLE 3

Wypall ® X80 Steel Blue Wiper

| Physical Properties (Average) | Units | Control | std dev | 1-pass | std dev | 2 pass | std dev |
|---|---|---|---|---|---|---|---|
| Basis Weight | gsm | 127.1 | — | 125.5 | — | 124.4 | — |
| Bulk | inches | 0.023 | 0.001 | 0.026 | 0.000 | 0.027 | 0.001 |
| Motor Oil Rate (50 weight) | seconds | 180.0 | 0.00 | 93.9 | 11.70 | 95.0 | 10.40 |
| Motor Oil Capacity (50 weight) | % | 383 | 5.72 | 527.5 | 20.39 | 641.00 | 17.04 |
| Water Rate | seconds | 6.72 | 0.32 | 3.95 | 0.21 | 4.06 | 0.22 |
| Water Capacity | % | 345.5 | 9.96 | 425.6 | 15.98 | 469.9 | 10.03 |
| Taber Abrasion, Pulp dry | cycles | 219.2 | 43.12 | 207.4 | 22.48 | 225.6 | 22.23 |
| Taber Abrasion, Pulp wet | cycles | 314.4 | 45.22 | 273 | 36.22 | 281.4 | 41.59 |
| Drape CD | centimeters | 2.77 | 0.21 | 3.04 | 0.18 | 2.20 | 0.29 |
| Drape MD | centimeters | 4.15 | 0.39 | 4.43 | 0.15 | 3.89 | 0.23 |
| Grab Tensile MD Dry | pounds | 31.40 | 2.49 | 29.69 | 1.44 | 24.31 | 1.33 |
| Grab Tensile MD Wet | pounds | 28.91 | 1.35 | 29.10 | 2.32 | 24.33 | 1.76 |
| Grab Tensile CD Dry | pounds | 18.49 | 1.80 | 17.19 | 1.44 | 14.99 | 0.32 |
| Grab Tensile CD Wet | pounds | 17.11 | 1.02 | 15.69 | 1.21 | 12.09 | 1.49 |
| Gelbo Lint Count | >5 microns | 169.6 | 62.60 | 168 | 60.50 | 53.2 | 10.50 |
| Gelbo Lint Count | >10 microns | 123.6 | 47.30 | 101.4 | 33.00 | 29.4 | 0.90 |
| Gelbo Lint Count | >25 microns | 52.8 | 31.00 | 39.2 | 8.50 | 9.2 | 2.60 |
| Gelbo Lint Count | >50 microns | 16.6 | 8.60 | 16.2 | 5.30 | 3.8 | 1.90 |
| Gelbo Lint Count | >65 microns | 10.4 | 5.00 | 12.2 | 3.40 | 2.4 | 1.70 |
| Gelbo Lint Count | >80 microns | 5.2 | 2.70 | 8.2 | 1.90 | 1.8 | 1.50 |

As indicated, various properties of the abraded samples were improved in comparison to the non-abraded control samples. For example, the abraded samples had a motor oil capacity approximately 35 to 67% higher than the control samples. The abraded samples also had a water capacity approximately 20 to 35% higher than the control samples. In addition, the abraded samples had a generally lower drape stiffness than the control samples.

Figure 6:
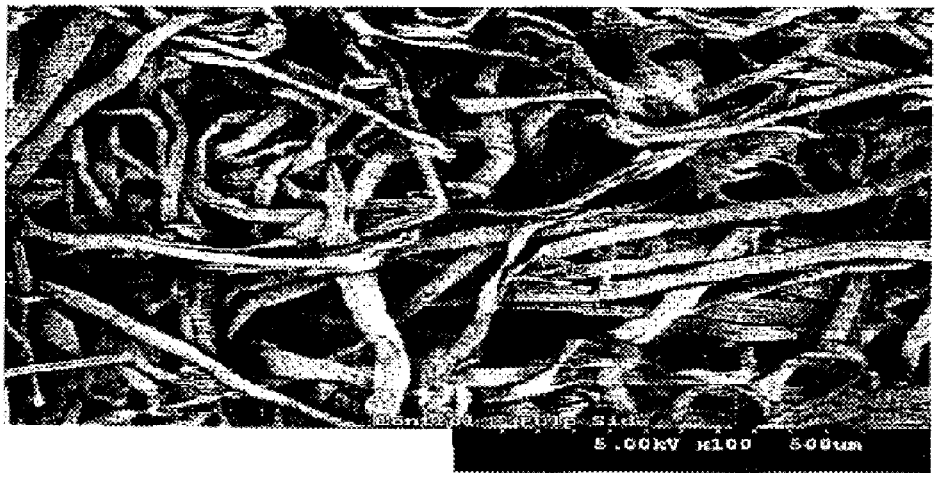
FIG. 6 is an SEM photograph of the pulp side of the control Wypall® X80 Red wiper sample of Example 1.
Figure 7:
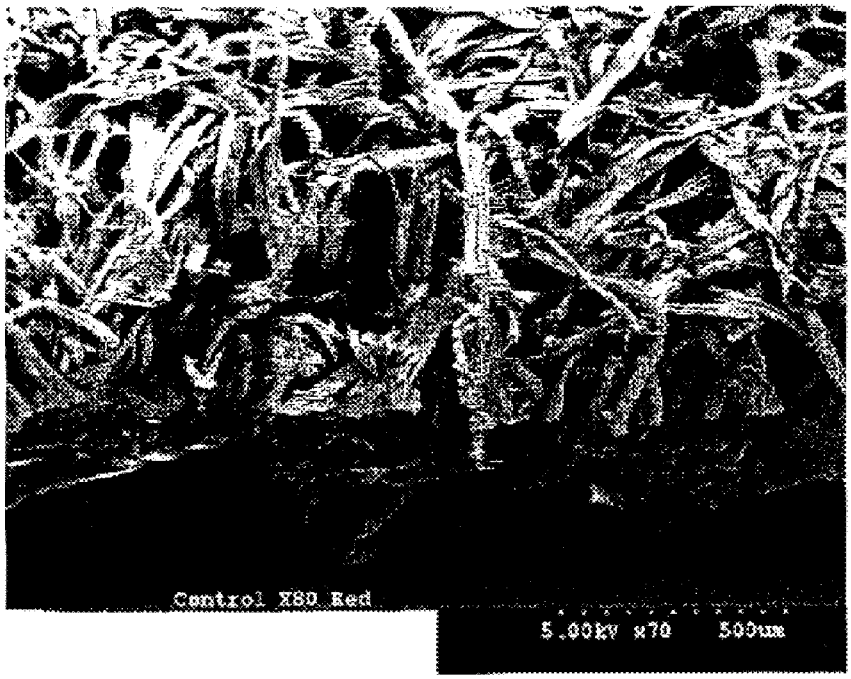
FIG. 7 is an SEM photograph (45 degree cross section) of the pulp side of the control Wypall® X80 Red wiper sample of Example 1.
Figure 8:
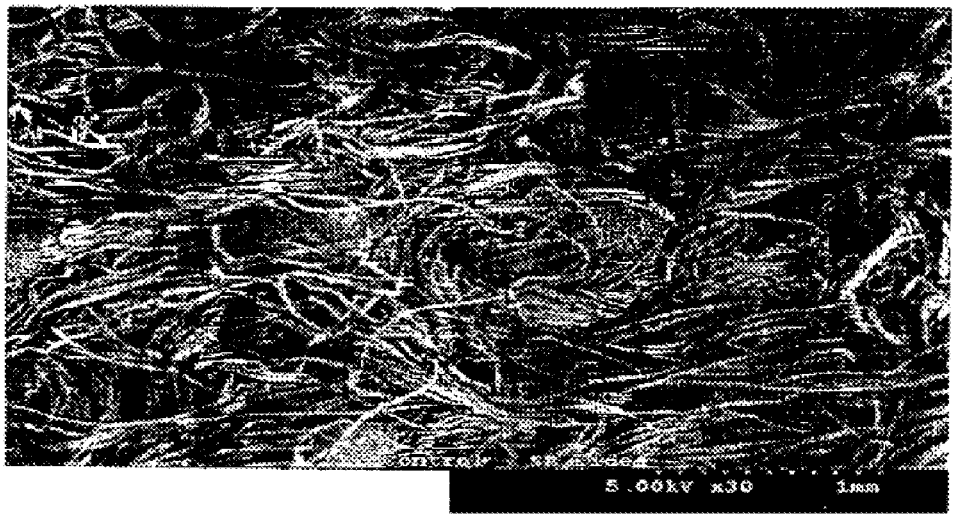
FIG. 8 is an SEM photograph of the spunbond side of the control Wypall® X80 Red wiper sample of Example 1.

SEM photographs of the non-abraded Wypall® Red wiper control sample are shown in FIG. 6 (pulp side), FIG. 7 (45 degree angle), and FIG. 8 (spunbond side). The control sample shows fibers intertwined together and compacted on the surfaces.

Figure 9:
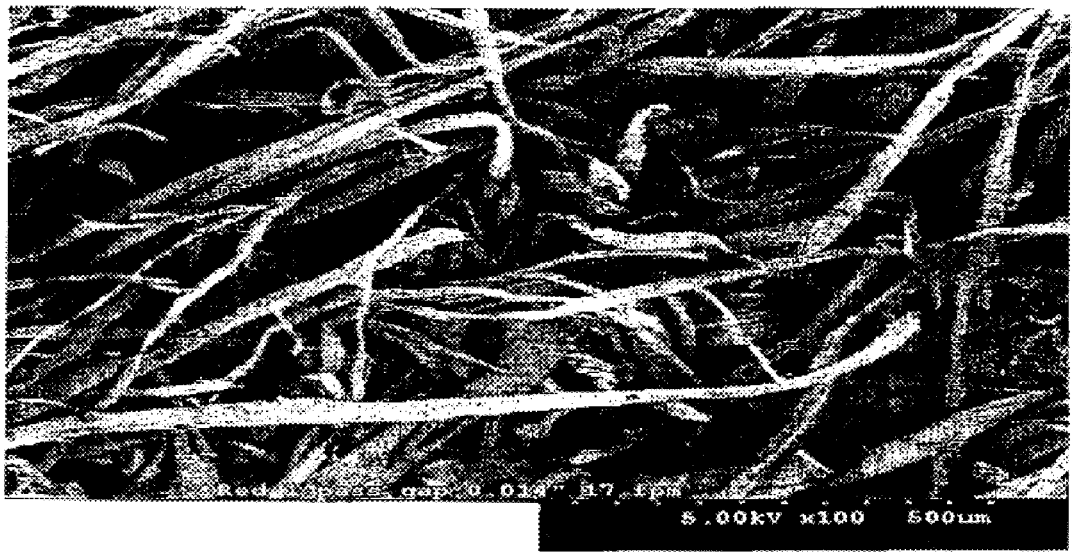
FIG. 9 is an SEM photograph of the pulp side of the abraded Wypall® X80 Red wiper sample of Example 1 (1 pass), in which the gap was 0.014 inches and the line speed was 17 feet per minute.
Figure 10:
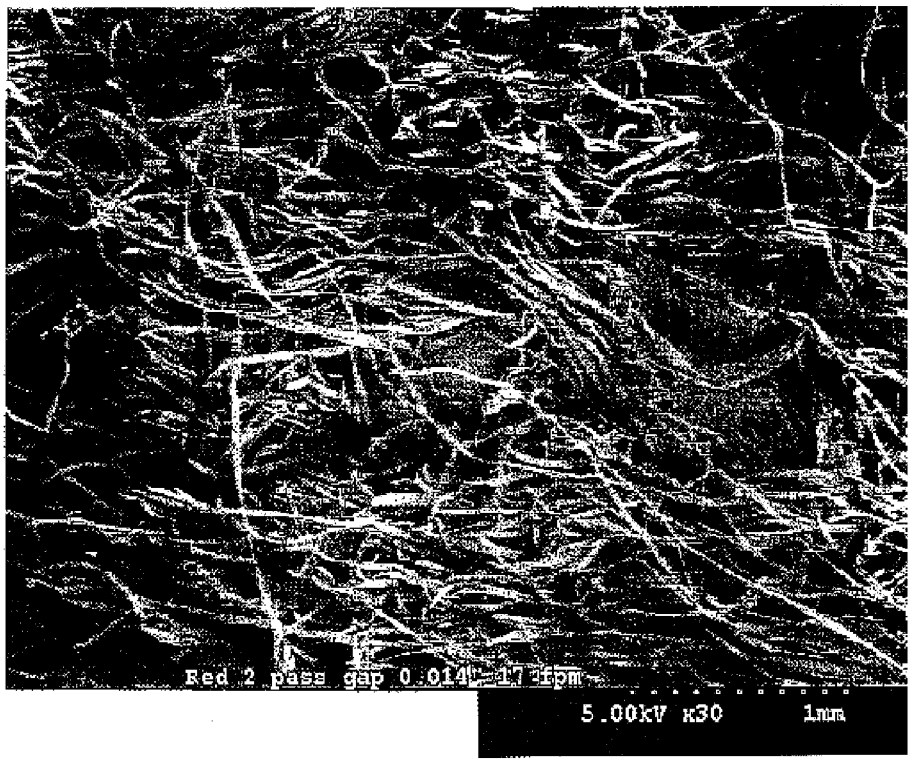
FIG. 10 is an SEM photograph of the spunbond side of the abraded Wypall® X80 Red wiper sample of Example 1 (2 pass), in which the gap was 0.014 inches and the line speed was 17 feet per minute.

SEM photographs of the Wypall® Red wiper abraded at a gap of 0.014 inches and a line speed of 17 feet per minute are shown in FIG. 9 (pulp side, 1 pass) and FIG. 10 (spunbond side, 2 pass). As shown in FIG. 9, the surface fibers are aligned in a more uniform direction (sanding direction) and possess a larger number of exposed fibers relative to the control sample. Likewise, FIG. 10 shows the abraded sample with fibers more uniform in size and aligned in the same direction. The fibers also cover a greater area of the exposed thermal bond points of the underlying spunbond web.

EXAMPLE 2

Wypall® X80 Blue Steel wipers, which are commercially available from Kimberly-Clark Corporation, were provided. The wipers were formed from nonwoven composite materials in substantial accordance with U.S. Pat. No. 5,284,703 to Everhart, et al. Specifically, the wipers had a basis weight of 125 grams per square meter (gsm), and were formed from a spunbond polypropylene web (22.7 gsm) hydraulically entangled with northern softwood kraft fibers.

The wipers were abraded under various conditions using a 620 Series microgrinder obtained from Curtin-Hebert Co., Inc. of Gloversville, N.Y., which is substantially similar to the sander shown in FIG. 2. Specifically, each sample was first abraded on its pulp-side (1 pass) and tested for various properties. Thereafter, one of the samples was also abraded on the spunbond-side (2 pass) using the identical abrasion conditions. The abrasion roll in each pass oscillated 0.25 inches in the cross-direction of the samples to ensure that the roll did not become filled with fibers and that grooves were not worn into the roll.

The abrasion conditions for each pass are set forth below in Table 4:

TABLE 4

| Abrasion Conditions | |
|---|---|
| Processing Condition | Wypall ® X80 Blue Wiper |
| Width In (inches) | 50 |
| Width Out (1 pass) (inches) | 49 |
| Width Out (2 pass) (inches) | 48 |
| Linear Feet | 22500 |
| Line Speed (fpm) | 17 |
| Average Particle Size (microns) | 122 |
| Abrasive Roll Speed (fpm) | 2700 |
| Abrasive Roll Oscillation (inches) | 0.25 |
| Abrasive Roll Diameter (inches) | 30 |
| Pressure Roll Type | Steel |

The gap, i.e., the distance between the abrasion roll and the pressure roll, varied from 0.014 to 0.024 inches. Once abraded, various properties of the wipers were then tested. The control Wypall® Steel Blue sample of Example 1 (designated sample 1 in Table 5) was also tested and compared to Samples 2–6.

Table 5 sets forth the results obtained for the Wypall® X80 Steel Blue wiper.

The single-ply wipers were Wypall® X80 Red wipers, which are commercially available from Kimberly-Clark Corporation. Wypall®X80 Red wipers are nonwoven composite materials made in substantial accordance with U.S. Pat. No. 5,284,703 to Everhart, et al. Specifically, the wipers have a basis weight of 125 grams per square meter (gsm), and are formed from a spunbond polypropylene web (22.7 gsm) hydraulically entangled with northern softwood kraft fibers.

Each ply of the two-ply wiper was a Wypall® X60 wiper, which is commercially available from Kimberly-Clark Corporation. Wypall® X60 wipers are nonwoven composite materials made in substantial accordance with U.S. Pat. No. 5,284,703 to Everhart, et al. Specifically, the wipers have a basis weight of 64 grams per square meter (gsm), and are formed from a spunbond polypropylene web (11.3 gsm) hydraulically entangled with northern softwood kraft fibers.

All fourteen (14) wiper samples were abraded under various conditions. Samples 1–3 were abraded using stationary breaker bar(s). Specifically, the pulp side of sample 1 was abraded with a steel breaker bar in the manner shown in FIG. 3. Specifically, the breaker bar was wrapped with sandpaper having a grit size of 60 (avg. particle size of 254 microns). Sample 2 was abraded with two stationary steel breaker bars in the manner shown in FIG. 5. Specifically, the breaker bar contacting the upper surface 151 of the sample (spunbond side) was wrapped with sandpaper having a grit size of 60 (avg. particle size of 254 microns), while the breaker bar contacting the lower surface 153 (pulp side) of the sample was wrapped with sandpaper having a grit size of 220 (avg. particle size of 63 microns). Sample 3 was abraded in the manner shown in FIG. 4. Specifically, the breaker bar contacting the upper surface 151 (spunbond side) of the sample was wrapped with sandpaper having a grit size of 60 (avg. particle size of 254 microns), while the three (3) breaker bars contacting the lower surface 153 (pulp side) of the sample was wrapped with sandpaper having a grit size of 220 (avg. particle size of 63 microns).

Samples 4–6 were abraded using napping rolls on which were contained wire carding brushes or filets obtained from ECC Card Clothing, Inc. of Simpsonville, S.C. Specifically, the wire brushes of Samples 4–5 had a pin height of 0.0285 inches, with the pins being mounted on a 3-ply, 1.5-inch

TABLE 5

| Wypall ® X80 Steel Blue Wiper | | | | | | | | | | | | | | |
|---|---|---|---|---|---|---|---|---|---|---|---|---|---|---|
| | | Drape MD | Drape CD | Taber Abrasion Pulp Side (cycles) | | Bulk | Grab Tensile Wet (lbs) | | Grab Tensile Dry (lbs) | | Oil Capacity 30 wt. | Oil Rate 30 wt. | Water Capacity | Water Rate |
| Sample | Gap (in) | (cm) | (cm) | Wet | Dry | (in) | CD | MD | CD | MD | (%) | (sec) | (%) | (sec) |
| 1 | N/A | 2.77 | 4.15 | 314 | 219 | 0.023 | 17.1 | 28.9 | 18.5 | 31.4 | 383 | 180 | 345 | 6.7 |
| 2 | 0.0140 | 3.04 | 4.43 | 273 | 207 | 0.026 | 15.7 | 29.1 | 17.2 | 29.7 | 528 | 94 | 426 | 4.0 |
| 3 | 0.0185 | 2.84 | 4.13 | 316 | 237 | 0.027 | 16.2 | 28.0 | 16.6 | 28.3 | 502 | 84 | 412 | 4.1 |
| 4 | 0.0200 | 3.09 | 3.86 | 125 | 484 | 0.025 | 16.2 | 29.7 | 17.7 | 29.0 | 503 | 74 | 412 | 4.3 |
| 5 | 0.0240 | 3.12 | 3.94 | 132 | 257 | 0.025 | 18.0 | 31.0 | 19.1 | 29.7 | 460 | 95 | 384 | 5.3 |
| 6 | 0.0180 (pulp)/ 0.0240 (spunbond) | 2.20 | 3.89 | 281 | 226 | 0.027 | 12.1 | 24.3 | 15.0 | 24.3 | 641 | 83 | 470 | 4.1 |

Figure 11:
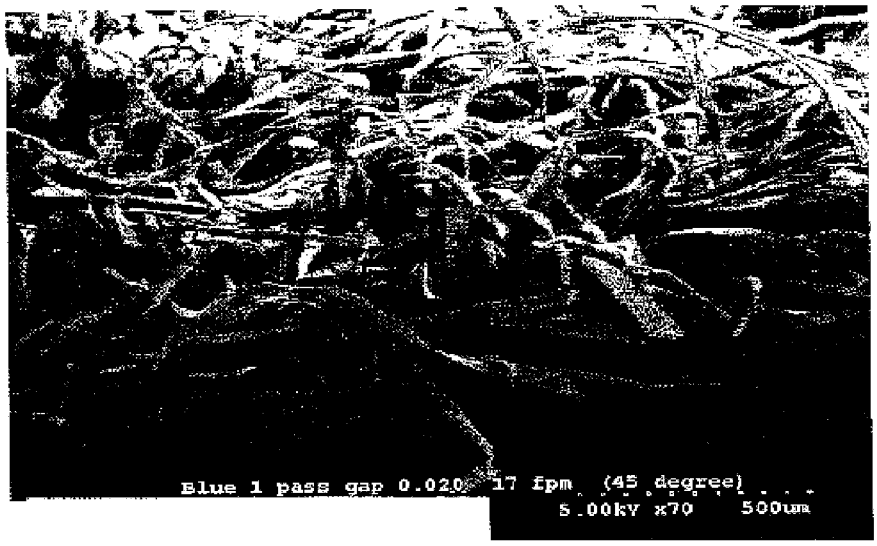
FIG. 11 is an SEM photograph (45 degree cross section) of Sample 4 of Example 2.

As indicated, various properties of the abraded samples were improved in comparison to the non-abraded control samples. In addition, as indicated, greater gap distances generally resulted in a lower reduction of strength. On the other hand, smaller gap distances had a greater impact on certain properties, such as liquid capacity and intake rate. FIG. 11 is an SEM photograph of Sample 4 (45 degree angle). The surface fibers of the abraded sample shown in FIG. 11 are aligned in a uniform direction (sanding direction).

EXAMPLE 3

Fourteen (14) wiper samples were provided. Samples 1–13 were one-ply wipers, while sample 14 was a two-ply wiper (two plies glued together).

wide rubber belting. The wire brushes of Sample 6 had a slightly angled pin height of 0.0410 inches mounted on the same rubber belting. Both sets of brushes had a 6×3×11 configuration, with "6" representing the number of rows per inch, "3" representing the number of wires or staple anchors used to attach the staples to the belting material, and "11" representing the number of wire or staple repeats per inch.

The napping rolls were mounted onto separate electrically-driven unwind stands, and positioned against the surface of the sample as it was wound under tension between an unwind and power winder. The rolls rotated in a direction opposite to that of the moving samples at a speed of 1800 feet per minute. A quick draft vacuum was positioned near the surface of the sample to remove dust, particles, etc., generated during abrasion.

Samples 7–13 were abraded using a roll wrapped with sandpaper. For samples 7–8, 10, 12, and 14, only the pulp side was abraded. For samples 9, 11, and 13, both sides were abraded. The sandpaper rolls were formed from a standard paper core having an outside diameter of 3 inches. The rolls were cut to a length of 10.5 inches, and wrapped with sandpaper having a grit size of 60 (avg. particle size of 254 microns). Samples 7 and 9–14 were wrapped lengthwise to form a single seam. Sample 8 was wrapped with individual 2-inch strips spaced apart 0.5 inches. The rolls were mounted onto separate electrically-driven unwind stands, and positioned against the surface of the sample as it was wound under tension between an unwind and power winder. The rolls rotated in a direction opposite to that of the moving samples at a speed of 1800 feet per minute. A quick draft vacuum was positioned near the surface of the sample to remove dust, particles, etc., generated during abrasion.

The conditions of abrasion are summarized below in Table 6.

TABLE 6

Abrasion Conditions

| Sample | Line Speed (fpm) | Roll Speed (rpm) | Side(s) Abraded |
|---|---|---|---|
| 1 | 100 | N/A | Pulp |
| 2 | 200 | N/A | Pulp/Spunbond |
| 3 | 200 | N/A | Pulp |
| 4 | 65 | 1800 | Pulp |
| 5 | 100 | 1800 | Pulp |
| 6 | 100 | 1800 | Pulp |
| 7 | 100 | 1800 | Pulp |
| 8 | 100 | 1800 | Pulp |
| 9 | 100 | 1800 | Pulp/Spunbond |
| 10 | 400 | 1800 | Pulp |
| 11 | 400 | 1800 | Pulp/Spunbond |
| 12 | 800 | 1800 | Pulp |
| 13 | 800 | 1800 | Pulp/Spunbond |
| 14 | 400 | 1800 | Pulp |

Several properties of certain of the samples were then tested and compared to a control sample that was not abraded. The results are set forth below in Table 7.

TABLE 7

Sample Properties

| Sample | | Drape CD (cm) | Drape MD (cm) | Bulk (inches) | Oil Capacity (%) | Oil Rate (sec.) |
|---|---|---|---|---|---|---|
| Control | Avg | 2.98 | 3.2 | 0.024 | 299.4 | 69.1 |
| | Std Dev | 0.10 | 0.05 | 0 | 10.8 | 1.0 |

TABLE 7-continued

Sample Properties

| Sample | | Drape CD (cm) | Drape MD (cm) | Bulk (inches) | Oil Capacity (%) | Oil Rate (sec.) |
|---|---|---|---|---|---|---|
| Sample 3 | Avg | 2.98 | 3.85 | 0.023 | 324.2 | 64.6 |
| | Std Dev | 0.24 | 0.265 | 0 | 2.1 | 1.5 |
| Sample 11 | Avg | 2.55 | 3.367 | 0.024 | 375.2 | 62.9 |
| | Std Dev | 0.30 | 0.202 | 0 | 3.3 | 1.7 |
| Sample 13 | Avg | 2.67 | 3.233 | 0.025 | 380.7 | 54.1 |
| | Std Dev | 0.24 | 0.076 | 0 | 5.2 | 0.5 |
| Sample 4 | Avg | 2.62 | 4.05 | 0.025 | 369.4 | 49.5 |
| | Std Dev | 0.19 | 0.173 | 0 | 12.9 | 0.9 |

As indicated, the abraded samples formed according to the present invention achieved excellent physical properties. For example, each of the abraded samples tested possessed a higher oil capacity than the control sample.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a fabric comprising:

providing a nonwoven web that contains thermoplastic fibers;

entangling said nonwoven web with absorbent staple fibers to form a composite material, said composite material defining a first surface and a second surface; and abrading said first surface of said composite material by contacting said first surface of said composite material with abrasive particles, wherein said abrading is carried out by contacting said first surface of said composite material with a roll that rotates in a clockwise or counterclockwise direction.

2. A method as defined in claim 1, wherein said nonwoven web is a spunbond web.

3. A method as defined in claim 2, wherein said spunbond web comprises polyolefin fibers.

4. A method as defined in claim 1, wherein said absorbent staple fibers comprise greater than about 50 wt. % of said composite material.

5. A method as defined in claim 1, wherein said absorbent staple fibers comprise from about 60 wt. % to about 90 wt. % by weight of said composite material.

6. A method as defined in claim 1, wherein said nonwoven web is hydraulically entangled with said absorbent staple fibers.

7. A method as defined in claim 1, wherein said abrasive particles have an average particle size of from about 1 to about 1000 microns.

8. A method as defined in claim 1, wherein said abrasive particles have an average particle size of from 20 to about 200 microns.

9. A method as defined in claim 1, wherein said abrasive particles have an average particle size of from about 30 to about 100 microns.

10. A method as defined in claim 1, wherein said composite material moves in a linear direction relative to said roll.

11. A method as defined in claim 10, wherein said roll rotates in a direction opposite to the direction in which said composite material is moving.

12. A method as defined in claim 1, wherein said roll rotates at a speed of from about 500 to about 6000 revolutions per minute.

13. A method as defined in claim 1, wherein said roll rotates at a speed of from about 1000 to about 4000 revolutions per minute.

14. A method as defined in claim 1, wherein said composite material moves at a linear speed of from about 100 to about 4000 feet per minute.

15. A method as defined in claim 1, wherein said composite material moves at a linear speed of from about 1500 to about 3000 feet per minute.

16. A method as defined in claim 1, further comprising abrading said second surface of said composite material.

17. A method as defined in claim 1, further comprising providing a vacuum force from an exhaust system to remove debris remaining on said first surface after abrading.

18. A method for forming a fabric comprising:

providing a nonwoven web that contains thermoplastic continuous fibers;

hydraulically entangling said nonwoven web with pulp fibers to form a composite material, said pulp fibers comprising greater than about 50 wt. % of said composite material, said composite material defining a first surface and a second surface; and abrading said first surface of said composite material by contacting said first surface of said composite material with abrasive particles, wherein said abrasion is carried out by contacting said first surface of said composite material with a roll that rotates in a clockwise or counterclockwise direction.

19. A method as defined in claim 18, wherein said nonwoven web is a spunbond web that comprises polyolefin fibers.

20. A method as defined in claim 18, wherein said pulp fibers comprise from about 60% to about 90% by weight of said composite material.

21. A method as defined in claim 18, wherein said abrasive particles have an average particle size of from about 20 to about 200 microns.

22. A method as defined in claim 18, wherein said abrasive particles have an average particle size of from about 30 to about 100 microns.

23. A method as defined in claim 18, wherein said composite material moves in a linear direction relative to said roll.

24. A method as defined in claim 23, wherein said roll rotates in a direction opposite to the direction in which said composite material is moving.

25. A method as defined in claim 18, wherein said roll rotates at a speed of from about 500 to about 6000 revolutions per minute.

26. A method as defined in claim 18, wherein said roll rotates at a speed of from about 1000 to about 4000 revolutions per minute.

27. A method as defined in claim 18, wherein said composite material moves at a linear speed of from about 100 to about 4000 feet per minute.

28. A method as defined in claim 18, wherein said composite material moves at a linear speed of from about 1500 to about 3000 feet per minute.

29. A method as defined in claim 18, further comprising abrading said second surface of said composite material.

30. A method as defined in claim 18, further comprising providing a vacuum force from an exhaust system to remove debris remaining on said first surface after abrading.

31. A method for forming a fabric comprising:

providing a spunbond web that contains thermoplastic polyolefin fibers;

hydraulically entangling said spunbond web with pulp fibers to form a composite material, said pulp fibers comprising from about 60 wt. % to about 90 wt. % of said composite material, said composite material defining a first surface and a second surface; and sanding said first surface of said composite material with sand paper, wherein said sand paper is wrapped around a roll that rotates in a clockwise or counterclockwise direction.

32. A method as defined in claim 31, further comprising sanding said second surface of said composite material.

33. A method as defined in claim 31, further comprising providing a vacuum force from an exhaust system to remove debris remaining on said first surface after sanding.

* * * * *